US005252043A

United States Patent [19]

Bolding et al.

[11] Patent Number: 5,252,043

[45] **Date of Patent: * Oct. 12, 1993**

[54] LINEAR MOTOR-PUMP ASSEMBLY AND METHOD OF USING SAME

[75] Inventors: Vance E. Bolding, Chino Hills, Calif.; John S. Stiebel, Washington, D.C.; Frank L. Unmack, La Mesa, Calif.

[73] Assignee: Uniflo Oilcorp Ltd., La Mesa, Calif.

[ * ] Notice: The portion of the term of this patent subsequent to Jan. 12, 2010 has been disclaimed.

[21] Appl. No.: 760,748

[22] Filed: Sep. 16, 1991

Related U.S. Application Data

[60] Continuation-in-part of Ser. No. 751,977, Aug. 29, 1991, Pat. No. 5,179,306, which is a continuation-in-part of Ser. No. 611,186, Nov. 9, 1990, Pat. No. 5,193,985, which is a division of Ser. No. 462,833, Jan. 10, 1990, Pat. No. 5,049,046.

[51] Int. Cl.[5] ..... F04B 17/04; F04B 35/04

[52] U.S. Cl. ..... 417/417; 417/418

[58] Field of Search ..... 417/417, 418, 259

[56] References Cited

U.S. PATENT DOCUMENTS

| | | | |
|---|---|---|---|
| 1,822,242 | 9/1931 | Schöngut | 417/418 |
| 3,364,864 | 1/1968 | Gheorghe | 417/418 |
| 4,687,054 | 8/1987 | Russell et al. | 417/417 X |
| 4,768,595 | 9/1988 | Smith | 417/417 X |
| 4,815,949 | 3/1989 | Rabson | 417/417 X |
| 5,049,046 | 9/1991 | Escue et al. | 417/411 X |

*Primary Examiner*—Richard A. Bertsch
*Assistant Examiner*—Alfred Basichas
*Attorney, Agent, or Firm*—Bernard L. Kleinke; Jerry R. Potts

[57] ABSTRACT

A new and improved linear motor-pump assembly and method of using it for downhole use. The assembly includes a cartridge unit with a linear motor attached threadably between a discharge housing assembly adapted to be secured removably to a cable for hoisting the cartridge unit through the production tubing of a well and a suction housing assembly for facilitating the pumping of well fluids from a downhole well. The linear motor includes a mover adapted to engage threadably a stop valve for permitting one-way flow of fluid through the mover and into the discharge housing for discharge into the production tubing. For increased pumping efficiency, the suction housing and check valve are replaceable with a lifting pump and piston respectively. Thus, the assembly is usable in both shallow and deep wells.

13 Claims, 4 Drawing Sheets

LINEAR MOTOR-PUMP ASSEMBLY AND METHOD OF USING SAME

CROSS-REFERENCE TO RELATED APPLICATIONS

This is a continuation-in-part of U.S. patent application Ser. No. 07/751,977, filed on Aug. 29, 1991, entitled "A SMALL DIAMETER BRUSHLESS DIRECT CURRENT LINEAR MOTOR AND METHOD OF MAKING SAME", now U.S. Pat. No. 5,179,306 which is a continuation-in-part of U.S. patent application Ser. No. 07/611,186, filed Nov. 9, 1990, entitled "PUMP CONTROL SYSTEM FOR A DOWNHOLE MOTOR-PUMP ASSEMBLY AND METHOD OF USING SAME", now U.S. Pat. No. 5,193,985 which is a division of U.S. patent application Ser. No. 07/462,833, filed Jan. 10, 1990, entitled "PUMP CONTROL SYSTEM FOR A DOWNHOLE MOTOR-PUMP ASSEMBLY AND METHOD OF USING SAME", now U.S. Pat. No. 5,049,046.

TECHNICAL FIELD

The present invention relates in general to a motor and pump assembly and method of using such an assembly in a well, and it more particularly relates to a linear motor-pump assembly and method of using the same for removing fluids from a well.

BACKGROUND ART

There have been many different types and kinds of motor and pump assemblies for removing well fluids from a well. For example reference may be made to the following U.S. Pat. Nos. 4,350,478; 4,477,235; 4,687,054; and 4,815,949. Each one of the above mentioned patent describes a motor for use with a pump for fluid pumping purposes. While such combinations are generally desirable in many applications, the use of such electromechanical devices necessitate periodic replacement. In this regard, conventional replacement techniques have required that well production tubing generally attached to such motor-pump assemblies, be removed from the well in order to replace the motor-pump assembly. Following such repair or replacement, the entire structure of the production tubing and the motor-pump assembly must then be reinstalled in the well. Such repair and replacement procedures are both time consuming and expensive.

Because of the above mentioned problems, several attempts have been made to improve such procedures. In this regard, U.S. Pat. No. 4,350,478 mentioned above describes an improved procedure where a motor-pump assembly is supported from below by a seat attached to the end of the production tubing, thus enabling the assembly to be extracted from the well by raising (and lowering) the assembly within the production tubing of the well. While this method of removing and replacing the motor-pump assembly from a well is desirable, such an assembly would be so unwieldy in length that it would be difficult, if not impossible to transport and install such an assembly using conventional transportation and installation equipment.

Another attempt at solving such problems is disclosed in the above-mentioned U.S. patent application Ser. No. 07/462,833. The motor-pump assembly disclosed in this application has a significantly larger transverse to axial length ratio thus, the disclosed assembly may be readily transported and installed with conventional equipment. As noted in this application however, significant design tradeoffs are involved in developing a motor with sufficient thrust to efficiently and effectively drive a pump for removing fluids from a well.

For example, it is well known that in order for a piston to push liquid out of a cylinder, such as the production tubing of a well, it must operate against the hydrostatic pressure of the fluid within that cylinder. In this regard, the hydrostatic pressure of raising fluids from a shallow well of 300 feet compared to a deep well of 5000 feet for example, are significantly different. Thus, although a given motor-pump assembly may be completely satisfactory for operation in a shallow well, such a given assembly, unless designed for deep well operation, would be completely unacceptable in a deep well.

Therefore, it would be highly desirable to have a new and improved motor-pump assembly that would be universally adaptable for use in both shallow and deep wells.

DISCLOSURE OF INVENTION

Therefore, it is the principal object of the present invention to provide a new and improved linear motor-pump assembly which is highly efficient and readily useable in both shallow and deep wells.

Another object of the present invention is to provide such a new and improved linear motor-pump assembly and method of using it so that it can be coupled to a conventional pump to provide additional pumping capabilities.

Briefly, the above and further objects of the present invention are realized by providing a new and improved linear motor-pump assembly and method of using it for downhole use. The assembly includes a cartridge unit with a linear motor attached threadably between a discharge housing assembly adapted to be secured removably to a cable for hoisting the cartridge unit through the production tubing of a well and a suction housing assembly for facilitating the pumping of well fluids from a downhole well. The linear motor includes a mover adapted to engage threadably a stop valve for permitting one-way flow of fluid through the mover and into the discharge housing for discharge into the production tubing. For increased pumping efficiency, the suction housing and check valve are replaceable with a lifting pump and piston respectively. In addition, the linear motor has a modular construction permitting additional sections to be added for increasing thrusting capacity. Thus, the assembly is usable in both shallow and deep wells.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
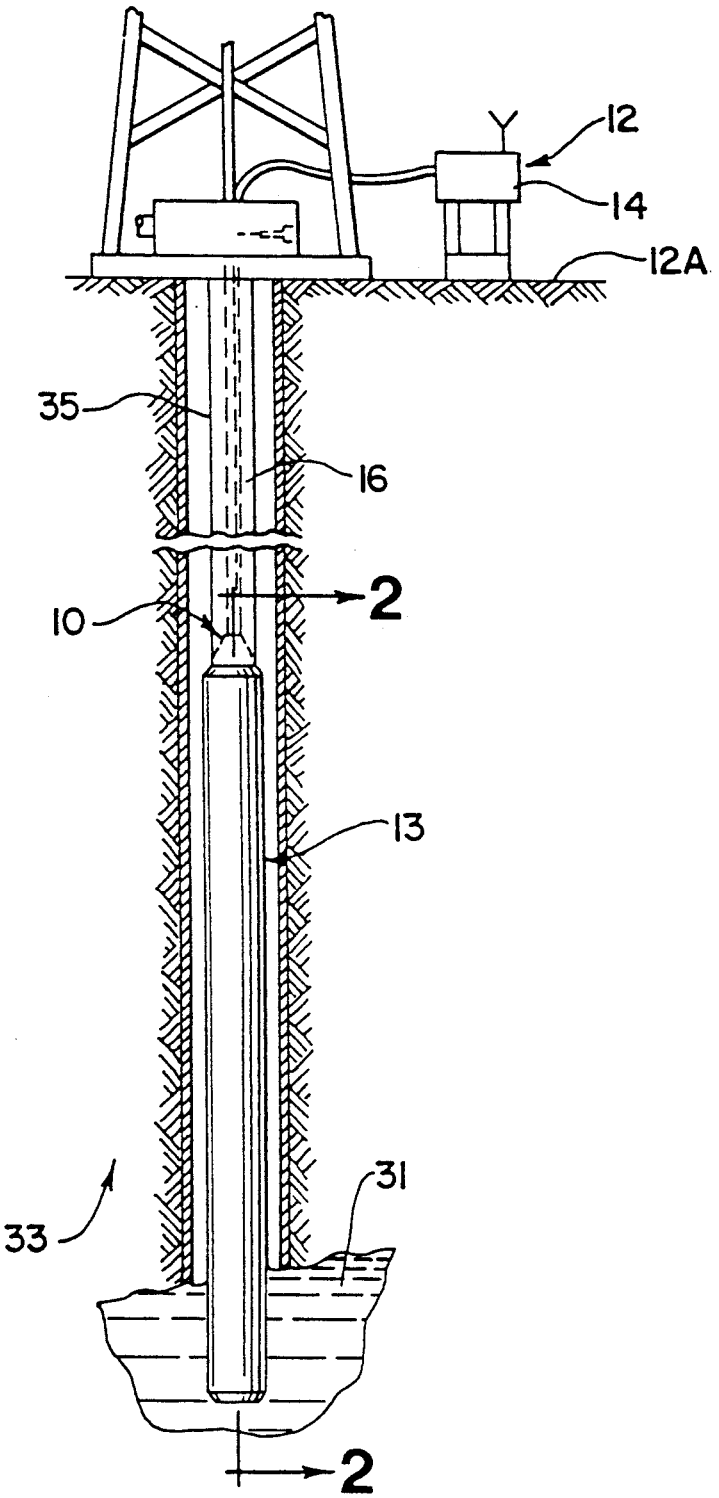
FIG. 1 is a sectional view of a well containing an linear motor-pump assembly which is constructed in accordance with the present invention and which is shown disposed in a sleeve assembly.
Figure 2:
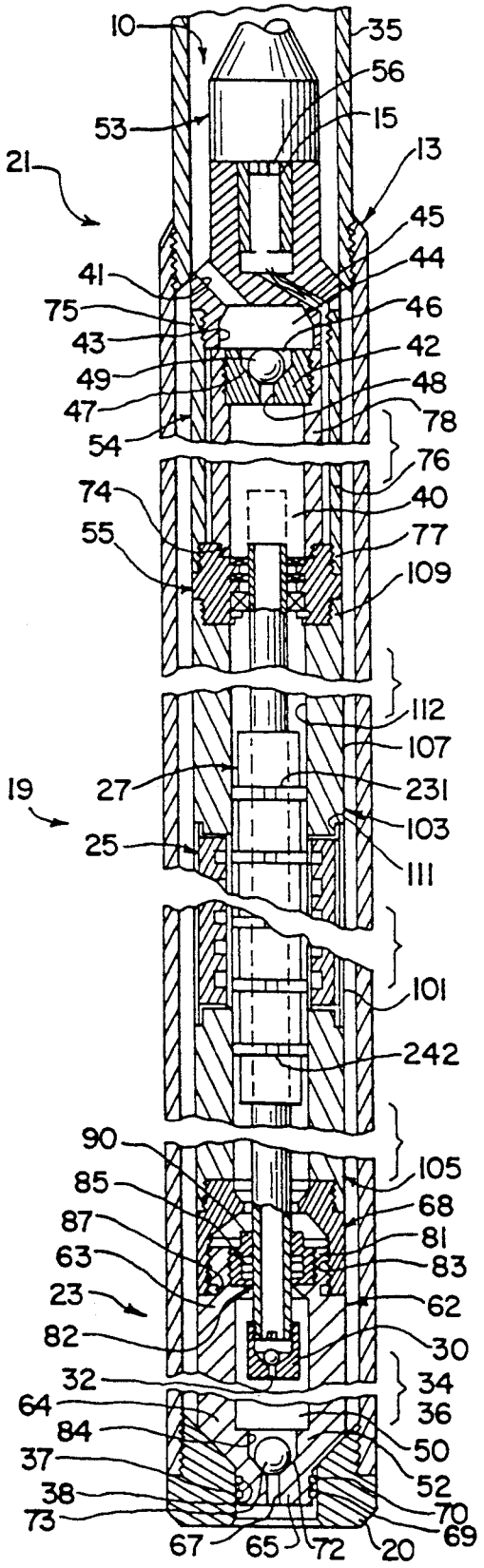
FIG. 2 is a greatly enlarged cross sectional view of the linear motor-pump assembly of FIG. 1.

Referring now to the drawings, and more particularly to FIGS. 1 and 2 thereof there is shown a linear motor-pump assembly 10 which is constructed in accordance with the present invention and which is adapted for use with a motor controller 12 and sleeve assembly 13. The sleeve assembly 13 is attached to the terminal end of a production tubing 35 extending downhole in a well 33 and supports from below the motor-pump assembly 10 for fluid pumping purposes. The motor controller 12 controls the operation of the linear motor-pump assembly 10 and includes a surface motor control unit 14 (FIG. I) and a downhole motor control electronic unit 15. In the preferred embodiment of the present invention, the downhole motor control electronic unit 15 (FIG. 2) is disposed within the motor-pump assembly 10 and interconnected to the surface motor control unit 14 by a power hoist cable 16 which provides an electrical conduction path for the electrical power supplied to the motor-pump assembly 10. The motor controller 12 and sleeve assembly 13 are more fully described in copending U.S. patent application Ser. No. 07/751,977.

Although in the preferred embodiment of the present invention the motor control unit 14 is a pulse type unit which supplies current pulses downhole for energization purposes it will be understood by those skilled in the art that other type and kinds of control arrangements may be employed which do not require the sending of high current pulses down hole. For example, although the motor control electronic unit 15 is shown disposed within the motor-pump assembly 10, it will be understood by those skilled in the art that such a control unit may be disposed at the surface level or another location spaced apart from the motor pump assembly depending upon the well and its downhole equipment.

Considering now the linear motor-pump assembly 10 in greater detail with reference to FIGS. 1 and 2, the linear motor-pump assembly 10 generally comprises a linear motor shown generally at 19 which is attached threadably between a discharge housing assembly shown generally at 21 adapted to be secured removably to the cable 16 for hoisting purposes and a suction housing assembly shown generally at 23 for facilitating the pumping of well fluids from a down-hole well, such as the well 33. The linear motor 19, the discharge housing assembly 21 and the suction housing assembly 23 are secured together removably to form an elongated annularly-shaped cartridge-like assembly that may be hoisted as an integrated unit within a production tubing of a well, such as the tubing 35.

The linear motor 19 has a modular type construction and includes an elongated annularly-shaped electromagnetic stator assembly 25 coupled electrically to the motor controller 12 and an elongated hollow rod-like mover assembly 27 for interacting electromagnetically with the stator assembly 25 and for providing a fluid conduit to help facilitate the pumping of well fluids, shown generally at 31, from the well 33. The mover assembly 27 is mounted telescopically within the stator assembly 25 and moves reciprocatively along a path of travel between a pair of fluid chambers disposed within the discharge housing assembly 21 and the suction housing assembly 23, respectively. In this regard, whenever the stator assembly 25 is electrically energized by the motor controller 12 the stator 25 coacts electromagnetically with the mover 27 to urge the mover along its path of travel between an elongated fluid discharge chamber 40 disposed within the discharge housing assembly 21 and an elongated fluid suction chamber 50 disposed within the suction housing assembly 23. The mover assembly 27 is adapted to be attached threadably to a foot check valve shown generally at 30 that travels reciprocatively with the mover 27 and that cooperates with the suction chamber 50 to enable fluids to flow into the suction chamber 50, thence through the mover assembly 27 into the discharge chamber 40, and thence to be discharged into the production tubing 35.

As best seen in FIG. 2, when the motor-pump assembly 10 is seated within the sleeve assembly 13, the discharge chamber 40 is in fluid communication with the production tubing 35 via a discharge port 41 and a check valve 42. The stop valve 42 cooperates with the mover assembly 27 for facilitating the discharge of well fluids into the production tubing 35. In a similar manner, the suction chamber 50 is in fluid communication with the fluids in the well 33 via a suction stop valve 52 that cooperates with the mover assembly 27 for facilitating the receiving of well fluids within the suction housing 23.

In operation, when the motor-pump assembly 10 is received within the sleeve assembly 13, a fluid tight seal is formed between the lower portion of the motor-pump assembly 10 and the sleeve 13. This fluid tight seal prevents well fluids 31 from returning to the reservoir of fluids in the well 33, so that fluids accumulate within the sleeve assembly 13 and the production tubing 35 to flow upwardly to the surface. Hence, in operation when the stator assembly 25 is energized it coacts electromagnetically with the mover assembly 27 to cause well fluids to flow from the well sump through the suction stop valve 52, and into the suction pumping chamber 50, when the mover 27 is disposed at its fluid input position (FIG. 2) on its path of travel.

When the mover 27 moves rectilinearly towards the suction stop valve 52 along its downward path of travel, the fluids within the suction chamber 50 are prevented from flowing back into the sump by the stop valve 52. In this regard, the downward thrust of force exerted by the mover 27 causes the fluid pressure within the chamber 50 to rise a sufficient amount to permit fluids trapped within the chamber 50 to flow through the foot valve 30 and into the discharge chamber 40 via the over 27.

As the mover 27 moves reciprocatively back toward the discharge stop valve 42 the fluids within the discharge chamber 40 are prevented from flowing back into the suction chamber 50 by the foot valve 30. In this regard, as the mover 27 travels along its path of travel towards the discharge stop valve 42, the mover 27 causes the fluid pressure within the chamber 40 to rise a sufficient amount above the hydrostatic pressure in the chamber 40 to force fluids trapped within the chamber 40 to flow through the discharge stop valve 42 and into the interior of the sleeve assembly 13 and thence, upwardly into the production tubing 35. As this process is repeated, the fluid volume in the production tubing 35 increases causing a net flow of fluid outwardly from the production tubing 35 at the surface level.

Considering now the stator assembly 25 in greater detail with reference to FIGS. 2 to 6, the stator assembly 25 generally comprises an annularly-shaped stator 101 and a pair of spaced apart annularly-shaped housing sections 103 and 105 respectively. The stator 101 is disposed between the housing sections 103 and 105 and cooperate with them to define a path of travel for the mover assembly 25. In the preferred embodiment of the present invention the stator assembly 25 defines a path of travel of about twenty-four inches. This path of travel, however may be increased in order to provide increased thrust for deeper wells. In this regard, the stator assembly and mover assembly are so constructed and arranged that their overall lengths may be increased on a section by section basis as will be explained hereinafter in greater detail.

The housing sections 103 and 105 are coupled threadably to the discharge housing assembly 21 and suction housing assembly 23 respectively to form a cartridge-like unit with a very small transverse to axial ratio. The housing sections 103 and 105 are substantially similar to one another so only housing section 103 will be described in greater detail.

Considering now the housing section 103 in greater detail with reference to FIG. 2, the housing section 103 generally includes a hollow cylindrically shaped central body portion 107, an integrally connected upper threaded neck portion 109 and an integrally connected lower threaded skirt portion 111. The threaded skirt portion 111 is adapted to be received threadably within the stator 101 for securing purposes. In a similar manner, the threaded neck portion 109 is adapted to secure threadably the housing section 13 to the discharge housing assembly 21 as will be explained hereinafter in greater detail.

As best seen in FIG. 2, the body portion 107 has an internal bore 112 with a diameter that is dimensioned to engage frictionally a set of spaced apart annularly shaped bearings, such as the bearings 231–236 forming part of the mover assembly 27. A similar set of bearings such as bearings 237–242 are disposed on the opposite end of the mover assembly 27 to engage the inner surface of the housing 115 in a like manner.

Considering now the stator 101 in greater detail with reference to FIGS. 3 to 6 the stator 101 generally comprises an outer annularly-shaped sheath 113 with an inner containment tube 115 mounted telescopically therein by a pair of end caps 117 and 119. The end caps 117 and 119 are received respectively within opposite ends of the sheath 113 and secured therein by any conventional technique such as adhesive bonding or seal welding. The containment tube 115 has an inner diameter that corresponds to the outer diameter of the mover bearings, such as the bearing 231 so the bearings engaging the inner surface of the tube 115 frictionally and travel therealong as the mover 27 traverses its path of travel.

The stator 101 also includes a centrally disposed core shown generally at 26 (FIG. 3) formed from a set of large circular laminated sections, such as the sections 121 and 123, and a set of small circular laminated sections 131 and 133. The laminations are composed of sheets of electrical grade silicone steel or other similar materials and are mounted axially along the outside surface of containment tube 115. In this regard, in order to align or position the laminated sections, such as sections 121, 123, 131 and 133 axially between the sheath 113 and the containment tube 115 a pair of elongated rods (not shown) extend along the entire axial length of the stator 101. Also, the sheath 113 is under tension to compress the lamination against the containment tube 115.

Figure 4:
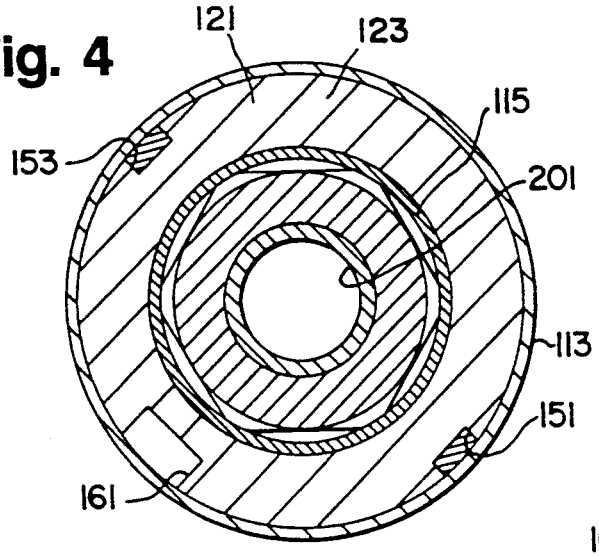
FIG. 4 is a transverse cross sectional view of the mover of FIG. 3 taken substantially along lines 4—4.
Figure 5:
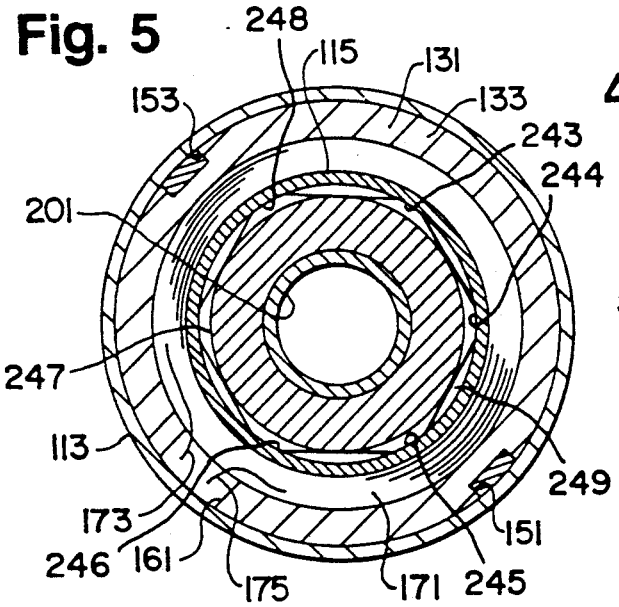
FIG. 5 is a transverse cross sectional view of the stator and mover of FIG. 3 taken substantially along lines 5—5.
Figure 3:
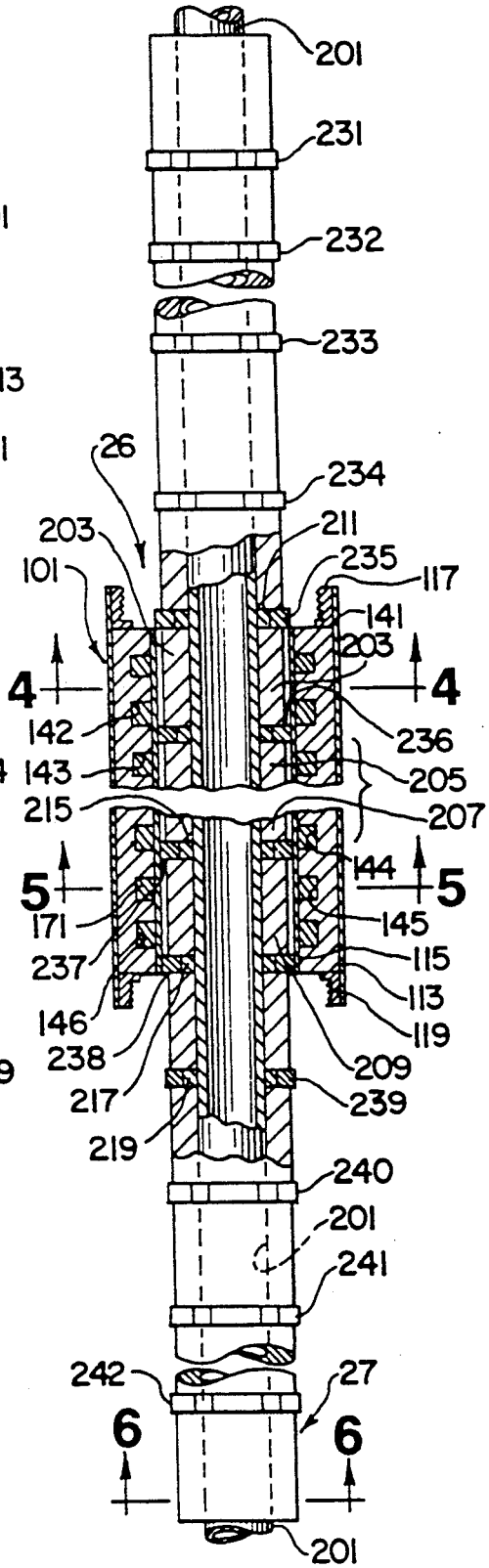
FIG. 3 is an enlarged partial fragmentary view of a mover and stator forming part of the linear motor-pump assembly of FIG. 2.

As best seen in FIG. 3, when the laminated sections, such as 121 and 123 of FIG. 4 or 131 and 133 of FIG. 5, are secured together in groups they define a series of spaced apart coil receiving slots, such as the slots 141–146, a pair of oppositely disposed axially extending rod receiving slots 151 and 153, (FIGS. 4 and 5) and a axially extending cable receiving slot 161. Each coil receiving slot, such as the slot 145 is dimensioned to receive therein an electromagnetic coil, such as the stator coil 171.

The stator coils are arranged in interconnected phase groupings as more fully described in copending U.S. patent application Ser. No. 07/751,977 and are interconnected by a set of conductors, such as the conductors 173 and 175 disposed within the cable receiving slot 161. As the phase groupings and electrical interconnections between the coil phase groping are substantially similar to those described in the above mentioned copending patent application no further detailed description will be provided herein.

As best seen in FIG. 2, the inner containment tube 115 protects the lamination sections and stator coils from making direct contact with the mover assembly 27. In this regard, the containment tube 115 is composed of a nonmagnetic material, such as non-magnetic stainless steel, nylon or Teflon, to permit proper electromagnetic reaction between the stator coils and the mover 27.

From the foregoing it should be understood that for increasing motor thrust, the overall length of the stator assembly 25 may be increased by providing additional laminations and coils and by increasing the length of the sheath, the containment tube, and the assembly rods.

Considering now the mover assembly 27 in greater detail with reference to FIGS. 3 to 6, the mover assembly 27 generally comprises an elongated hollow annular tube like member 201 which has mounted axially thereon (by means not shown) a set of spaced apart permanent magnets, such as the magnets 203, 205, 207 and 209. The magnets 203–209 are arranged axially with their respective north and south poles alternating along the tube 201 to establish corresponding pole-pairs that coact electromagnetically with the stator coils. The magnets are spaced apart along the tube 201 by a set of substantially nonmagnetic shunting spacers such as spacers 211, 213, 215, 217 and 219 which are also mounted by means not shown, axially along the tube 201. The arrangement of the magnets and spacers on the tube 201 is more fully described in copending U.S. patent application Ser. No. 07/751,977 and will not be further described.

As best seen in FIGS. 2 and 3 the mover ring bearings 231–242 to help facilitate the unimpeded rectilinear movement of the mover assembly 27 within the linear motor 19. In this regard, each ring bearing such as bearing 234 is mounted in overlying relationship with a corresponding spacer, such as the spacer 219 and extends axially outwardly a sufficient distance from the spacer 219 to engage the inner wall of the containment tube 115. As each of the ring bearings are substantially identical, only ring bearing 242 will be described hereinafter in greater detail.

Figure 6:
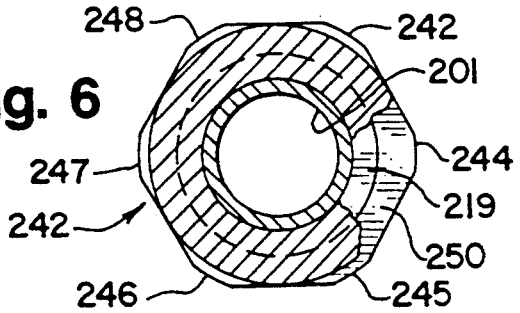
FIG. 6 is a transverse cross sectional view of the mover of FIG. 3 taken substantially along lines 6—6.

Considering now the ring bearing 242 in greater detail with reference to FIGS. 3 and 6, the ring bearing 242 is generally of unitary construction having a general ring shape body member 250 with a set of spoke-like bearing surfaces 243, 244, 245, 246, 247 and 248 that are equally spaced apart along the outer periphery of the body member 250. Each of the bearing surfaces, such as bearings 243 and 245 engage the inside wall of the containment tube 115 to help facilitate the movement of the mover 27 therealong and to form a fluid receiving clearance space, such as a clearance space 249 (FIG. 5) therebetween. Such a spacing arrangement between the containment tube wall and the bearing surfaces permit lubricating fluids to be disposed within the clearance space and the housings 103 and 105 for helping to reduce frictional forces and bearing wear.

From the foregoing, it should be understood that for increasing motor thrust, the overall length of the mover assembly 27 may be increased in cooperation with increasing the length of the stator assembly 25. In this regard, the mover assembly 27 may be increased by providing additional magnets and bearings in proportion to the increased stator length.

Figure 7:
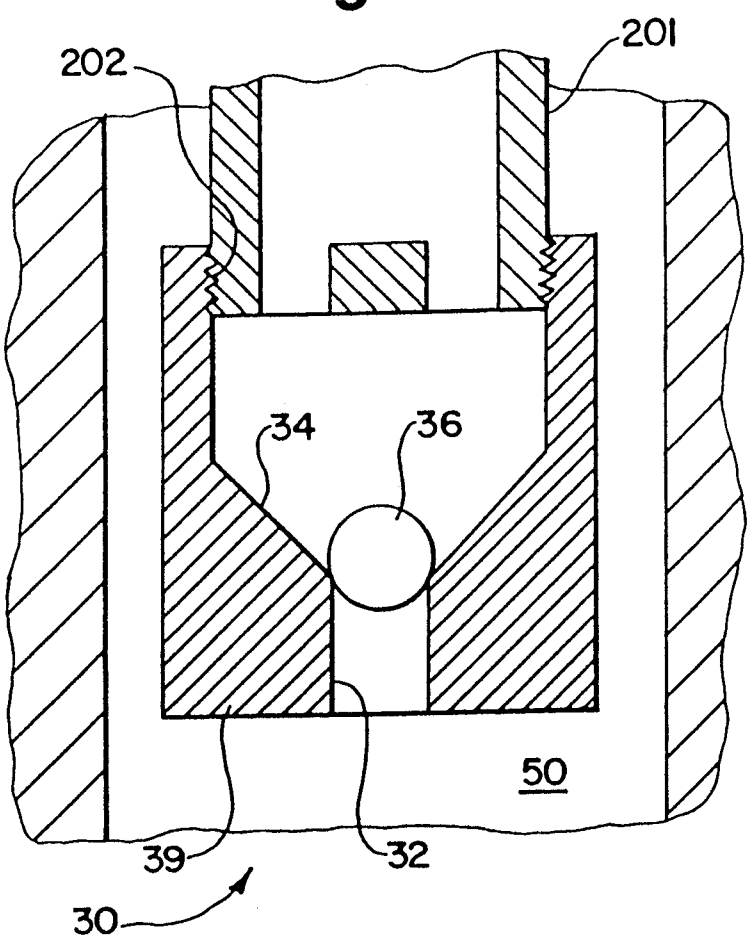
FIG. 7 is a cross sectional view of a stop valve assembly of FIG. 2.

As best seen in FIGS. 2 and 7, the inner tube 201 is sufficiently long to extend into both the discharge chamber 40 and the suction chamber 50 to define a fluid path therebetween via the linear motor 19. In this regard, in order to control the flow of well fluids through the tube 201, a lower end portion 202 (FIG. 7) of the tube 201 is adapted to receive threadably thereon the check valve 30. This arrangement permits the check valve 30 to travel reciprocatively within the chamber 50.

Considering now the stop valve 30 in greater detail with reference to FIG. 7, the stop valve 30 includes a body member 39 with a centrally disposed inlet 32 defining a fluid path between the interior of the tube 201 and the interior of the chamber 50. For the purpose of controlling the flow of fluid within the tube 201, the stop valve 30 also includes a tapered valve shoulder or seat 34 that is adapted to support a ball-like valve member 36 in the inlet 32. In this regard, the member 36 allows the flow of fluid upwardly into the tube 201 as the mover assembly 27 is moving rectilinearly downwardly, but blocks the down and out flow of fluids out through the inlet 32 as the mover assembly 27 is moving rectilinearly upwardly.

Considering now the suction housing assembly 23 in greater detail with reference to FIG. 2, the suction housing assembly 23 generally includes a sleeve engaging section 62 for receiving sump well fluids and for engaging sealingly the sleeve assembly 13 and an end bell section 68 which is secured threadably removably between the linear motor 19 and the suction chamber section 62 for providing a high pressure seal therebetween.

The sleeve engaging section 62 generally includes a hollow annular-shape barrel portion shown generally at 63 for coupling to the end bell 68 and an integrally formed generally conically shaped seat engaging portion 64 that cooperates with the barrel portion 63 to define the suction chamber 50. The suction chamber 50 is adapted to be in fluid communication with the sump fluids when the motor-pump assembly 10 is disposed downhole within the sleeve assembly 13. In this regard, the conically shaped seat engaging portion 64 includes a generally cylindrically shaped end portion 65 having a centrally disposed inlet 67. The end portion 65 is adapted to be received within a seat 20 forming part of the sleeve assembly 13. The end portion 65 includes a pair of spaced apart annular grooves 69 and 70 which are dimensioned to receive a metallic quad seal 37 and a neoprene wiper seal 38 respectively. The seals 37 and 38 form a fluid tight seal between the end portion 65 and the seat 20. In this regard, the seals 37 and 38 prevent fluids discharged within the sleeve assembly 13 and the production tubing 35 from returning to the well sump via the inlet within the seat 20.

As best seen in FIG. 2, the inlet 67 has a generally annular shape and extends upwardly axially. The upper portion of the inlet 67 diverges radially outwardly to define a conically shaped shoulder 72 or seat that is adapted to support a ball-like valve member 73 in the inlet 67. In this regard, when the mover travels upwardly toward the stop valve 42, the valve member 73 is pulled upwardly by suction allowing fluids to enter into the chamber 30. Contrawise, when the mover travels downwardly toward the seat 20, the valve member 73 blocks inlet 67 preventing the fluids in chamber 50 from returning to the well sump.

Considering now the suction chamber 50 in greater detail with reference to FIG. 2, the suction chamber 50 is generally cylindrically shaped having a centrally disposed upper opening 82 that is dimensioned to receive the lower end of the tube 201 therein and a centrally disposed lower opening or inlet 84 that is co-axially aligned with the opening 67 for permitting well fluids to pass into the chamber 50. The lower end of the suction chamber 50 terminates in the suction stop valve 52 that allows an upflow of well fluids into the suction chamber 50 but prevents down and outflow therefrom.

Considering now the barrel portion 63 in greater detail with reference to FIG. 2, the barrel portion 63 includes an upper annular threaded neck portion 81 defining an opening to the suction chamber 50. The neck portion 81 has a set of external threads 83 adapted to secure threadably the sleeve engaging section 62 to the end bell assembly 68.

As best seen in FIG. 2, a barrel gasket seal 87 is disposed on the exterior of the lower portion of the neck 81 that cooperates with the end bell assembly 68 to form a fluid tight seal between the gasket 87 and the end bell 68 when they are engaged threadably together.

The upper neck portion 81 also includes a hollowed out centrally disposed cylindrically-shaped recess portion having a set of threads 85 which are adapted to threadably receive and secure within the recess a high pressure sealing plug 90 between the linear motor 19 and the suction chamber 50. The centrally disposed opening 82 in the top of the chamber 50 extends into the base of the recess enabling the chamber 50 to be sealed by the plug 90. The opening 82 is dimensioned to receive therein the inner tube 201.

Considering now the high pressure sealing plug 90 in greater detail with reference to FIG. 2, the plug 90 includes a centrally disposed opening or bore which is aligned co-axially with and similarly dimensioned to the opening 82 in order to enable the tube 201 to pass freely therethrough. The exterior of the plug 90 is threaded for threadably engaging the threads 85. In order to prevent the leakage of the lubricating fluids within the linear motor 19 into the suction chamber 50 and in order to prevent the contaminate leakage of the well fluids into the stator 101, the sealing plug 90 includes an annularly shaped metallic quad high pressure seal and a spaced apart annularly shaped neoprene wiper seal. The high pressure seal and the wiper seal are spaced apart by a centrally disposed annularly-shaped metallic spacer. The seals as well as the spacer each include centrally disposed openings that are dimensioned to frictionally engage the tube 201 for fluid sealing purposes.

Considering now the discharge housing assembly 21 in greater detail with reference to FIG. 2, the discharge housing assembly 21 generally includes a cable housing 53 for coupling the control electronic unit 15 to the hoisting cable 16, a discharge head 54, for helping to control the flow of fluid out to the production tube 35, and a discharge bell 55 for sealing the discharge chamber 40 from the linear motor 19. The cable housing 53, discharge head 54, and discharge bell 55 are secured removably together.

Considering now the cable housing 53 in greater detail with reference to FIG. 2, the cable housing 53 is adapted to be coupled to the cable 16 and includes a centrally disposed chamber 56 that is dimensioned for receiving therein the electronic control unit 15.

The lower portion of the housing 53 defines a threaded neck portion 43 having a cup-shaped recess 44 disposed therein. The recess 44 is in fluid communication with the production tube 35 via the discharge port 41. The threaded neck portion 43 is adapted to secure threadably the cable housing 53 to the discharge head 54. The cable housing 53 also includes a conductor channel 45 for receiving the control lines coupled between the control unit 15 and each stator coils, such as coil 171.

Considering now the discharge head 54 in greater detail, the discharge head 54 generally comprises an upper threaded neck portion 75 adapted to engage threadably the cable housing 53 and a lower threaded neck portion 77 adapted to engage threadably the bell housing 55. An integrally formed barrel section 76 is disposed between the neck portions 75 and 76 for helping to define the discharge chamber 40.

For the purpose of controlling the flow of fluids through the discharge chamber 40, the barrel section 76 includes a cylindrically-shaped elongated sleeve 78 with a lower threaded skirt portion 74 adapted to couple the sleeve 78 threadably into the bell assembly 55. The upper end portion of the sleeve 78 is threaded internally and is dimensioned for receiving therein the stop valve 42. The sleeve 78 defines a path of travel for the upper portion of t he tube 201 forming part of the mover assembly 27.

Considering no the stop valve 42 in greater detail with reference to FIG. 2, the stop valve 42 is cylindrically shaped body member with an external thread adapted to permit the stop valve 42 to be received threadably in the sleeve 78. The stop valve 42 includes a centrally disposed opening 46 that is in fluid communication with the discharge port 41. The opening 46 extends downwardly terminating in a tapered shoulder 47. The shoulder 47 converges into a centrally disposed inlet 48 that is in fluid communication with the discharge chamber 40. A ball-like valve member 49 is supported by the shoulder 47 for blocking the inlet 48. In this regard, when the mover 27 travels upwardly toward the stop valve 42 it produces a sufficient amount of force to lift the valve member 49 and thus, opening the inlet 48 to permit fluids to pass from chamber 40 into the production tubing 35. When the mover 27 travels downwardly away from the valve 42, the valve member 49 falls under the force of gravity to once again block inlet 48 thus, preventing fluids in the production tube 35 from returning to the discharge chamber 40.

Considering now the bell assembly 55 in greater detail with reference to FIG. 2, the bell assembly 55 seals the discharge chamber 40 from the linear motor 19. In this regard, the bell assembly 55 includes a centrally disposed opening 56 that is dimensioned for permitting the tube 201 to pass therethrough. A set of seals are disposed in the bell as more fully described in copending U.S. patent application Ser. No. 07/751,977. In this regard, as the discharge bell assembly 55 is substantially similar to the bell assembly described in the above mentioned copending application it will not be described herein in greater detail.

Figure 8:
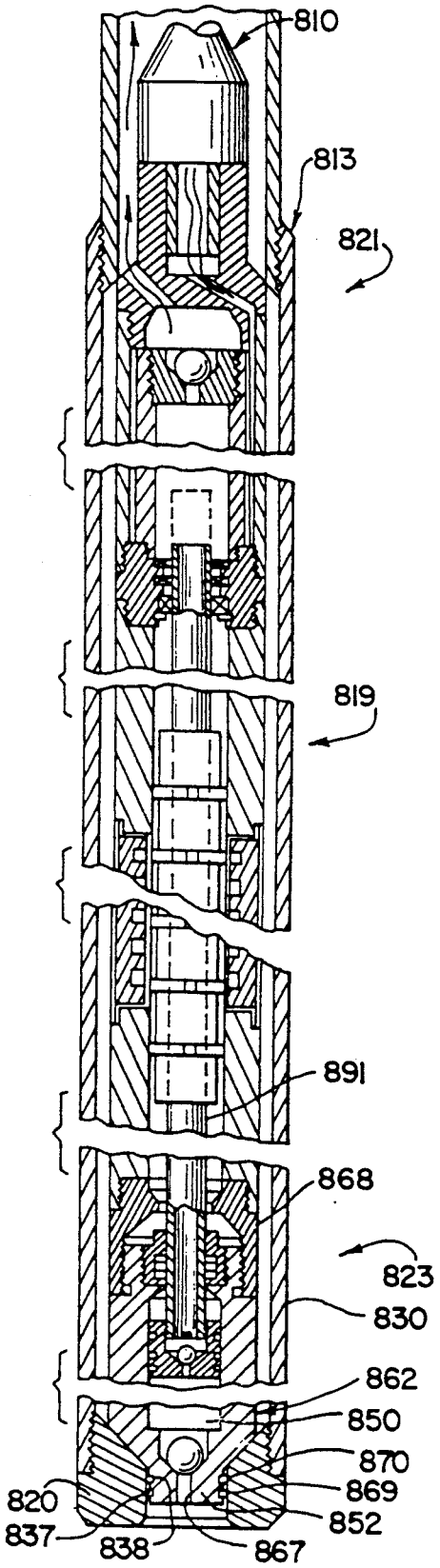
FIG. 8 is a greatly enlarged cross sectional view of another linear motor-pump assembly which is constructed in accordance with the present invention and which is shown disposed in a sleeve assembly.
Figure 9:
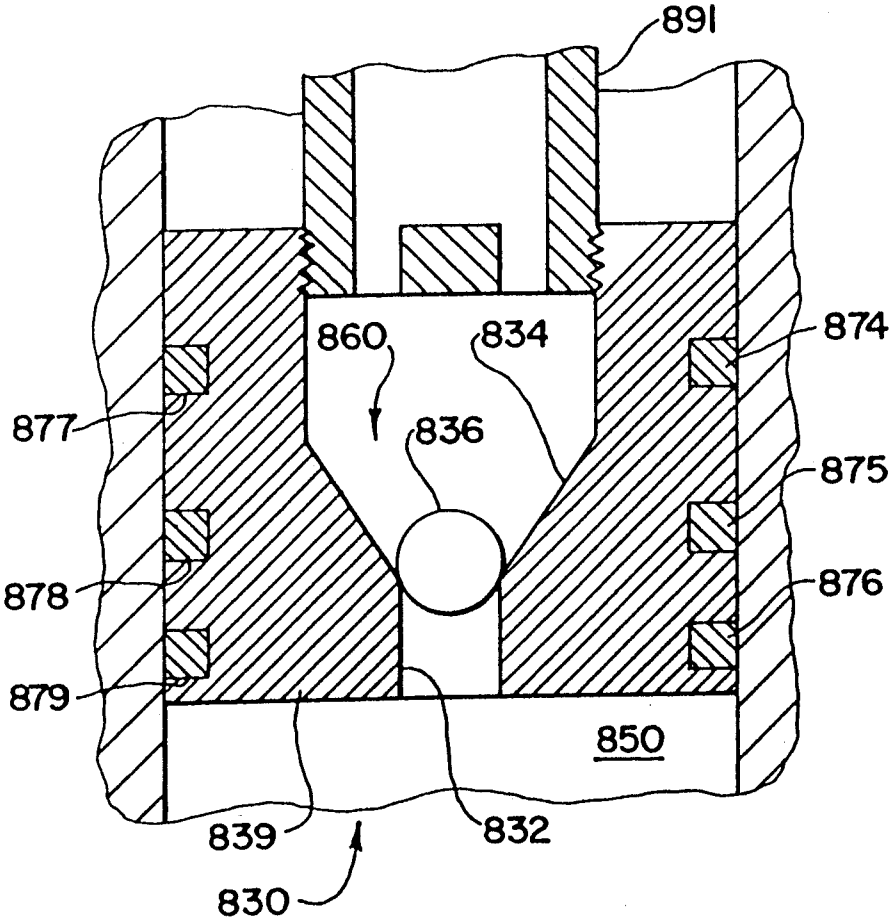
FIG. 9 is a cross sectional view of a piston assembly of FIG. 8.

Referring now to FIGS. 8 and 9 there is shown another linear motor assembly 810 which is also constructed in accordance with the present invention. The motor-pump assembly 810 includes a linear motor 819 disposed between a piston pump assembly 823 and a discharge assembly 821. As the linear motor 819 and discharge assembly 821 are substantially similar to assemblies 19 and 21 they will not be described.

Considering now the piston pump assembly 823 in greater detail with reference to FIGS. 8 and 9, the piston pump assembly 823 is adapted to be threadably attached to the linear motor 19 and generally includes a seat engagement section 862 and a bell housing assembly 868. The seat engagement section 862 is adapted to be received removably sealingly within the sleeve assembly 813 that is substantially the same as the sleeve assembly 13. In this regard the seat engagement section 860 includes a pair of spaced apart annular grooves 869 and 870 which are dimensioned to receive a metallic quad seal 837 and a neoprene wiper seal 838 respectively. The seals 837 and 838 form a fluid tight seal between the seat engagement section 860, 862 and a seat 80 forming part of the sleeve assembly 813 to prevent fluids discharged within the sleeve assembly and the production tubing of the well from returning to the well sump. As best seen in FIG. 7, the seat engagement section includes a ,centrally disposed inlet 867 that permits well fluids to enter a suction chamber 850 defined by the barrel of the seat engagement section 862.

Considering now the suction chamber 850 in greater detail with reference to FIG. 9, the suction chamber 850 is generally cylindrically shaped having a centrally disposed upper opening that is dimensioned to receive and support a hollow tube member 891 forming part of the linear motor 819. The diameter of the suction chamber 850 is dimensioned to accommodate therewithin a piston assembly 830 which is adapted to be attached threadably to the lower terminal end portion of member 898 is threaded to permit the piston assembly 830 to be attached threadably thereto.

As best seen in FIGS. 8 and 9, the piston assembly 830 is sealed dynamically to the inner walls of the suction chamber 850 to create a vacuum in that portion of chamber disposed below the piston assembly 830.

Considering now the piston assembly 830 in greater detail with reference to FIG. 8 and 9, the piston assembly 830 generally includes a body or piston member 839 for engaging the inner walls of the suction chamber 850 to create a vacuum pressure within the chamber 850 and stop valve 860 for controlling the flow of fluid through the body member 839.

As best seen in FIG. 9, the body member 839 includes a centrally disposed inlet 832 defining a fluid path between the interior of the tube 891 and the interior of the chamber 950. For the purpose of controlling the flow of fluid within the tube 891 the stop valve 860 includes a tapered valve shoulder 834 that is integrally formed with the body member 839. The shoulder 834 is adapted to support a bell-like valve member 836 that also forms part of the stop valve 860. The valve member 836 allows fluid flow upwardly into the tube 891 but prevents down and out flow from the tube 891 as the tube 891 moves upwardly away from the seat 820.

A set of spaced apart seals, such as seals 874–876 are disposed in a set of grooves 877-879 respectively disposed in the body member 839. In this regard, the seals 874–876 establish a fluid tight seal between the upper and lower portions of the chamber 850. In this regard, as the tube 891 moves downwardly fluids disposed within chamber 850 below the body member 839 are forced under pressure upwardly through the body member 839 and into the tube 891 thence into the discharge housing assembly 821 for discharge into the production tubing of a well.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A linear motor-pump unit, comprising:

elongated annular containment means for defining a path of travel;

stator means surrounding said containment means for establishing a series of spaced apart electromagnetic fields along aid path of travel;

said stator means having a very small transverse thickness to axial length ratio and including annular core means for defining a plurality of spaced-apart coil receiving slots, and coil means for producing said series of spaced apart electromagnetic fields, said fields extending at least partially in an axial direction when energized with an electric current;

said coil means including a plurality of individual annular-shaped coils disposed individually within said slots;

suction chamber means coupled to one terminal end of said stator means for defining a fluid receiving chamber having fluid inlet means for receiving fluids therein;

discharge chamber means coupled to the other terminal end of said stator means for defining a fluid discharge chamber having outlet means for discharging fluids therefrom;

mover means mounted telescopically within said stator means for interacting electromagnetically with said electromagnetic fields to urge said mover means reciprocatively along said path of travel;

said mover means including a hollow elongated fluid receiving tube member extending between and into said fluid receiving chamber and said fluid discharge chamber for enabling said chambers to be in fluid communication;

a plurality of annularly-shaped permanent magnets mounted externally on said tube member in an axially spaced apart manner for generating magnetic fields extending at least partially in an axial direction opposed to the fields produced by said coil means when individual ones of said magnets are disposed in opposition to corresponding individual ones of said coils to urge said mover means to produce relative movement between said stator means and said mover means;

a plurality of thin annularly-shaped spacers mounted on said tube member interleaved with said magnets for shunting a portion of said magnetic fields produced by said magnets to reduce substantially core flux losses in said core means;

valve means for establishing one-way flow of fluid into said tube member;

said tube member including mounting means for receiving said valve means thereon to permit said valve means to travel within said fluid receiving chamber and to permit fluids received within said fluid receiving chamber to flow into said fluid discharge chamber as said mover means travels along said path of travel towards said fluid inlet; and wherein said mover means further includes a plurality of bearing means for engaging said containment means to help facilitate the unimpeded reciprocative movement of said mover means as it is urged along said path of travel.

2. A linear motor-pump unit according to claim 11, wherein said mover means cooperating with outlet means to cause fluid pressure within said discharge chamber to rise a sufficient amount above the hydrostatic pressure in said discharge chamber to urge fluids within said discharge chamber to flow through said outlet mans as said mover means travels along said path of travel toward said outlet means.

3. A linear motor-pump unit according to claim 1, wherein said plurality of bearing means are spaced apart axially along said mover means.

4. A linear motor-pump unit according to claim 3, wherein each individual one of said plurality of bearing means includes a body member surrounding one individual spacer of said plurality of magnetic spacers.

5. A linear motor-pump nit according to claim 4, wherein said body member includes a set of spaced apart radially extending bearings for defining a plurality of fluid receiving spacers between said mover means and said containment means.

6. A linear motor-pump unit according to claim 5, wherein said valve means includes piston means for helping to facilitate the transfer of fluid between said suction chamber and said discharge chamber.

7. A linear motor-pump unit, comprising:

a stator having a very small transverse thickness to axial length ratio, said stator including annular core means defining a plurality of spaced-apart coil receiving slots, and coil means for producing a series of electromagnetic fields extending at least partially in an axial direction when energized with an electric current, said coil means including a plurality of individual annular coils disposed individually within said slots;

mover means for coacting electromagnetically with said coil means and being mounted within said core means; and said mover means including:

(a) an elongated member mounted telescopically reciprocatively within said core means;

(b) a plurality of annularly-shaped permanent magnets mounted on said member in an axially spaced apart manner for generating magnetic fields extending at last partially in an axial direction opposed to the fields produced by said coil means when individual ones of said magnets are disposed opposite corresponding individual ones of said coils to urge said mover to produce relative movement between said stator and said mover;

(c) a plurality of thin annularly-shaped spacers disposed on said member interleaved with said magnets for shunting a portion of said magnetic fields produced by said magnets to reduce substantially core flux losses in said core means; and wherein said mover means is hollow throughout its longitudinal length.

8. A linear motor-pump unit according to claim 7, wherein said mover means includes a plurality of bearing means for engaging said stator to help facilitate unimpeded relative movement between said mover means and said stator.

9. A linear motor-pump unit, comprising:

a stator having a very small transverse thickness to axial length ratio, said stator including annular core means defining a plurality of spaced-apart coil receiving slots, and coil means for producing a series of electromagnetic fields extending at least partially in an axial direction when energized with an electric current, said coil means including a plurality of individual annular coils disposed individually within said slots;

mover means for coacting electromagnetically with said coil means and being mounted within said core means; and said mover means including:

(a) an elongated member mounted telescopically reciprocatively within said core means;

(b) a plurality of annularly-shaped permanent magnets mounted on said member in an axially spaced apart manner for generating magnetic fields extending at least partially in an axial direction opposed to the fields produced by said coil means when individual ones of said magnets are disposed opposite corresponding individual ones of said coils to urge said mover to produce relative movement between said stator and said mover;

(c) a plurality of thin annularly-shaped spacers disposed on said member interleaved with said magnets for shunting a portion of said magnetic fields produced by said magnets to reduce substantially core flux losses in said core means;

wherein said mover means includes a plurality of spaced apart bearing rings for engaging said core means to help facilitate unimpeded relative movement between said core means and said mover means;

means for mounting each one of said plurality of bearing rings in overlaying relationship with corresponding individual ones of said plurality of spacers; and wherein each individual bearing ring extends axially outwardly a sufficient distance from a corresponding individual spacer to engage said core means to facilitate the unimpeded movement of said core means relative to said mover means.

10. A linear motor-pump unit according to claim 9, wherein each individual bearing ring includes a ring shaped body member having a set of spoke-like equally angularly spaced apart bearing surfaces extending along the periphery of said body member for helping to define a plurality of fluid receiving clearance spaces between pairs of the bearing surfaces and said core means.

11. A linear motor-pump unit according to claim 10, wherein each fluid receiving space is sufficiently large to permit lubricating fluid to be disposed therewith for helping to reduce frictional forces and bearing wear.

12. A method for pumping fluids, comprising:

using annular containment means for defining a path of travel;

surrounding said annular containment means with stator means, said stator means having a very small transverse thickness to axial length ratio and including annular core means for defining a plurality of spaced-apart coil receiving slots, and coil means disposed within said slots;

mounting a plurality of annularly-shaped permanent magnets externally on said mover means;

generating magnetic fields extending at least partially in an axial direction opposed to the fields produced by said coil means when individual ones of said magnets are disposed in opposition to corresponding individual ones of said coils to urge said mover means to produce relative movement between said stator means and said mover means;

coupling to one terminal end of said stator means a suction chamber having fluid inlet means for receiving fluids therein;

coupling to the other terminal end of said stator means a discharge chamber having outlet means for discharging fluids therefrom;

mounting mover means telescopically within said stator means to interact electromagnetically with said electromagnetic fields of urging said mover means reciprocatively along said path of travel and of establishing a fluid communication path between said suction chamber and said discharge chamber;

shunting a portion of said magnetic fields produced by said magnets to reduce substantially core flux losses in said core means;

mounting a stop valve in said fluid communication path to permit one-way flow of fluid only from said fluid receiving chamber to said fluid discharge chamber through said mover means as said mover means is urged rectilinearly toward said inlet means long said path of travel; and raising the fluid pressure within said discharge chamber a sufficient amount above the hydrostatic pressure in said discharge chamber to urge fluid to flow through said outlet means as said mover means travels along said path of travel toward said outlet means.

13. A method for pumping fluids according to claim 9, further comprising:

mounting piston means on said mover means; and establishing a dynamic seal between said piston means and said suction chamber to increase pumping efficiency.

* * * * *

UNITED STATES PATENT AND TRADEMARK OFFICE

CERTIFICATE OF CORRECTION

PATENT NO. : 5,252,043

DATED : October 12, 1993

INVENTOR(S) : Vance E. Bolding, et.al.

It is certified that error appears in the above-identified patent and that said Letters Patent is hereby corrected as shown below:

Column 11, line 47, delete "aid" and substitute therefor --said--.

Column 12, line 37, delete "11" and substitute therefor --1--.

Column 12, line 44, after "outlet", delete "mans" and substitute therefor --means--.

Column 14, line 63, delete "9" and substitute therefor --12--.

Signed and Sealed this

Nineteenth Day of April, 1994

Bruce Lehman

*Attest:*

BRUCE LEHMAN

*Attesting Officer*

*Commissioner of Patents and Trademarks*